US010855042B2

(12) United States Patent
Benatav

(10) Patent No.: US 10,855,042 B2
(45) Date of Patent: Dec. 1, 2020

(54) MULTIPLE DIAMETER WIRE CONNECTION

(71) Applicant: D.M. Benatav Ltd., Petach Tikva (IL)

(72) Inventor: Dror Benatav, Tel-Aviv (IL)

(73) Assignee: D.M. BENATAV LTD., Petach Tikva (IL)

( * ) Notice: Subject to any disclaimer, the term of this patent is extended or adjusted under 35 U.S.C. 154(b) by 0 days.

(21) Appl. No.: 16/320,165

(22) PCT Filed: Aug. 6, 2017

(86) PCT No.: PCT/IL2017/050863
§ 371 (c)(1),
(2) Date: Jan. 24, 2019

(87) PCT Pub. No.: WO2018/029674
PCT Pub. Date: Feb. 15, 2018

(65) Prior Publication Data

US 2019/0273353 A1 Sep. 5, 2019

Related U.S. Application Data

(60) Provisional application No. 62/373,588, filed on Aug. 11, 2016.

(51) Int. Cl.
*H01R 43/00* (2006.01)
*H01R 43/02* (2006.01)
(Continued)

(52) U.S. Cl.
CPC ..... *H01R 43/02* (2013.01); *H01R 4/021* (2013.01); *H01R 4/70* (2013.01); *H01R 43/0207* (2013.01);
(Continued)

(58) Field of Classification Search
CPC .. H01R 12/592; H01R 43/02; H01R 43/0207; H01R 4/021; H01R 4/029; H01R 4/625;
(Continued)

(56) References Cited

U.S. PATENT DOCUMENTS 3,259,685 A * 7/1966 Parrilli ..... H05B 33/06 174/261
3,602,684 A 8/1971 Friess
(Continued)

FOREIGN PATENT DOCUMENTS

WO 2012117512 A1 3/2011

OTHER PUBLICATIONS

Office Action dated Oct. 21, 2019 issued by Chinese Patent Office for parallel application 201780048865.7.
(Continued)

*Primary Examiner* — Thiem D Phan
(74) *Attorney, Agent, or Firm* — Chanoch Kahn; Simon Kahn

(57) ABSTRACT

A method of connecting a fine wire to an ultrafine wire, the fine wire exhibiting a first cross-section and the ultrafine wire exhibiting a second cross-section, the second cross-section smaller than the first cross-section, the method constituted of: providing an uninsulated portion of the fine wire exhibiting a flat surface; depositing a conductive material on the flat surface of the provided uninsulated portion of the fine wire; providing an uninsulated portion of the ultrafine wire; and bonding the provided uninsulated portion of the ultrafine wire to the deposited conductive material on the flat surface of the provided uninsulated portion of the fine wire by thermocompression.

15 Claims, 3 Drawing Sheets

(51) Int. Cl.
*H01R 4/02* (2006.01)
*H01R 4/70* (2006.01)
*H01R 4/62* (2006.01)

(52) U.S. Cl.
CPC ..... *H01R 4/625* (2013.01); *H01R 2201/12* (2013.01); *Y10T 29/49174* (2015.01)

(58) Field of Classification Search
CPC ..... H01R 4/70; Y10T 29/49174; Y10T 29/49176; Y10T 29/49192
USPC ..... 29/857, 854, 855, 858, 860, 867, 869
See application file for complete search history.

(56) References Cited

U.S. PATENT DOCUMENTS 5,111,989 A 5/1992 Holdgrafer et al.
6,045,367 A * 4/2000 Maldonado ..... H01R 13/2442 439/66
2006/0121773 A1 6/2006 Ichikawa et al.
2009/0318999 A1 12/2009 Hall
2014/0263584 A1 9/2014 Yap et al.

OTHER PUBLICATIONS

International Search Report for PCT/IL2017/050863 issued by European Patent Office Oct. 30, 2017.
Written Opinion of the International Searching Authority for PCT/IL2017/050863 issued by European Patent Office Oct. 30, 2017.
Spearing, Tsau, Schmidt; "Gold Thermocompression Wafer Bonding"; Proc. Advanced Materials for Micro- and Nano-Systems (AMMNS), 2004.
About Wire Bonding, downloaded from www.hybond.com Jun. 4, 2016.
White Paper: "Ultra-Fine Wire Technologies in Medical Devices", downloaded from www.benatav.com Mar. 2014.
Office Action dated May 8, 2020 issued by Chinese Patent Office for parallel application 201780048865.7.

* cited by examiner

MULTIPLE DIAMETER WIRE CONNECTION

CROSS-REFERENCE TO RELATED APPLICATION

This application claims priority from U.S. Provisional Patent Application Ser. No. 62/373,588 filed Aug. 11, 2016, the entire contents of which is incorporated herein by reference.

FIELD OF THE INVENTION

The invention relates generally to the field of electric and in particular to a method of connecting wires exhibiting a cross-section of a first diameter to wires exhibiting a cross-section of a second diameter, greater than the first diameter.

BACKGROUND OF THE INVENTION

Electronic devices, particularly medical sensors, often comprise devices produced with ultrafine wires. For example, in order to produce a medical sensor which is to be inserted into the body, there is often a need for coils acting as sensors, and in order to meet the demanding size requirements, these coils are produced from ultrafine wires, defined herein as wires with a maximal cross-section of less than 25 microns. In order to form a connection to the ultrafine wire devices, a printed circuit board (PCB) or a terminal connection has been provided in the prior art. Unfortunately, the demand for ever smaller devices makes the use of such a PCB or terminal connection difficult.

Such ultrafine wires are extremely challenging to work with, since they are very fragile and heat sensitive. Excess heat may result in wire erosion or wire burn. Due to their high fragility it is difficult to run the ultrafine wire outside of the device to an additional device or connection point. Instead, it is desired to connect the ultrafine wire to a more substantial wire, such as a fine wire, either in the device, or adjacent thereto, to enable connection to other device/connection points. As indicated above, it is often desired to accomplish same without the use of a PCB or terminal connection.

What is desired, and not provided by the prior art, is a method of connecting ultrafine wires to fine wires without the use of a PCB or a separate terminal.

SUMMARY

Accordingly, it is a principal object of the present invention to overcome at least some of the disadvantages of the prior art. In certain embodiments this is provided by a method of connecting an ultrafine wire to a fine wire, the fine wire exhibiting a first cross-section and the ultrafine wire exhibiting a second cross-section, the maximal second cross-section smaller than the first maximal cross-section, the method comprising: providing an uninsulated portion of the fine wire exhibiting a flat surface; depositing a conductive material on the flat surface of the provided uninsulated portion of the fine wire; providing an uninsulated portion of the ultrafine wire; and bonding the provided uninsulated portion of the ultrafine wire to the deposited conductive material on the flat surface of the provided uninsulated portion of the fine wire.

In one embodiment, the bonding is accomplished by thermocompression utilizing a predetermined temperature and pressure profile over a predetermined time. In another embodiment, the providing the uninsulated portion of the fine wire comprises removing a portion of insulation from the fine wire to expose the flat surface.

In one embodiment, the providing of the uninsulated portion of the fine wire comprises removing a section of the uninsulated portion of the fine wire to form the flat surface. In another embodiment, the depositing of conductive material comprises plating the flat surface with gold. In yet another embodiment, the thermocompression bonding is performed over a stable surface.

In one embodiment, the method further comprises depositing insulation material over the bonded conductive material and ultrafine wire. In one further embodiment, the insulation material exhibits adhesive properties. In one yet further embodiment, the insulation material comprises cyanoacrylate. In another embodiment, the provided ultrafine wire is wound as a coil.

Independently, a method of connecting a first wire to a second wire is enabled, the first wire exhibiting a first cross-section and the second wire exhibiting a second cross-section, the maximal second cross-section greater than the maximal first cross-section, the method comprising bonding a predetermined portion of the first wire to a conductive material deposited on a predetermined portion of the second wire by thermocompression utilizing a predetermined temperature and pressure profile over a predetermined time.

In one embodiment, the predetermined portion of the second wire is uninsulated and exhibits a flat surface, and wherein, prior to the bonding, the method further comprises depositing the conductive material on the flat surface of the predetermined portion of the second wire by plating the flat surface with gold. In one further embodiment, the method further comprises removing a portion of insulation from the predetermined portion of the second wire to expose the flat surface. In another further embodiment, the method further comprises removing a section of the predetermined portion of the second wire to form the flat surface.

In one embodiment, the conductive material comprises gold. In another embodiment the thermocompression bonding is performed over a stable surface. In another embodiment the maximal first cross-section is less than 25 microns and the maximal second cross-section is 25-100 microns. In one embodiment, the first wire is wound as a coil.

In one embodiment, the method further comprises depositing insulation material over the bonded conductive material and ultrafine wire. In one further embodiment, the insulation material exhibits adhesive properties. In one yet further embodiment, the insulation material comprises cyanoacrylate.

Independently, the embodiments enable a bonded structure of a fine wire exhibiting a first cross-section and an ultrafine wire exhibiting a second cross-section, the maximal second cross-section smaller than the first maximal cross-section, the bonded structure comprising: an uninsulated portion of the fine wire exhibiting a flat surface; a conductive material deposited on the flat surface of the uninsulated portion of the fine wire; an uninsulated portion of the ultrafine wire; and a thermocompression bond of the uninsulated portion of the ultrafine wire to the deposited conductive material.

In one embodiment, the deposited conductive material comprises gold. In one embodiment the bonded structure further comprises insulation material covering the thermocompression bond of the uninsulated portion of the ultrafine wire to the deposited conductive material. In one further embodiment, the insulation material exhibits adhesive properties. In one yet further embodiment, the insulation material comprises cyanoacrylate.

Additional features and advantages of the invention will become apparent from the following drawings and description.

BRIEF DESCRIPTION OF THE DRAWINGS

For a better understanding of various embodiments of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the accompanying drawings:

FIG. 1A illustrates a high level cut away view of an ultrafine wire and a fine wire with conductive material disposed thereon, according to certain embodiments;

FIG. 1B illustrates a high level side view of the fine wire and conductive material of FIG. 1A;

FIG. 1C illustrates cut away views of stages of creating a flat surface on the fine wire of FIG. 1A;

FIG. 1D illustrates an ultrafine wire being bonded to a fine wire by a thermocompression bonder according to certain embodiments;

FIG. 1E illustrates a stable structure formed of an ultrafine wire bonded to a fine wire according to certain embodiments;

FIG. 2 illustrates a high level flow chart of a method of connecting an ultrafine wire to a fine wire, according to certain embodiments; and FIG. 3 illustrates a high level flow chart of a method of connecting a first wire to a second wire, according to certain embodiments.

DETAILED DESCRIPTION

Figure 1A:
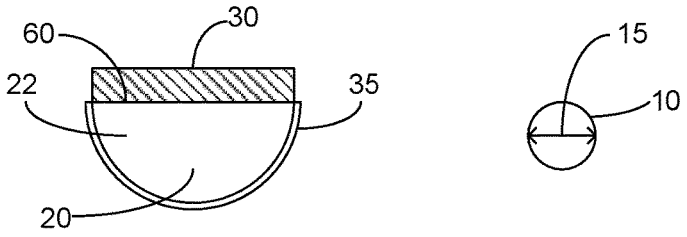

Before explaining at least one embodiment in detail, it is to be understood that the invention is not limited in its application to the details of construction and the arrangement of the components set forth in the following description or illustrated in the drawings. The invention is applicable to other embodiments being practiced or carried out in various ways. Also, it is to be understood that the phraseology and terminology employed herein is for the purpose of description and should not be regarded as limiting.

Figure 1B:
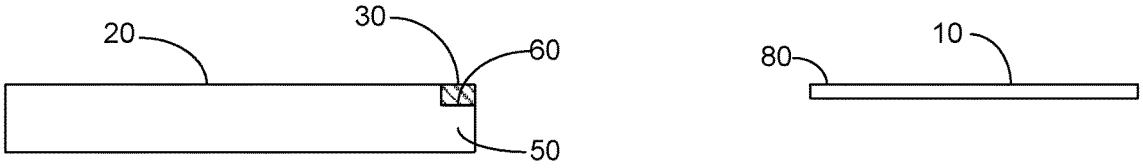
Figure 1C:
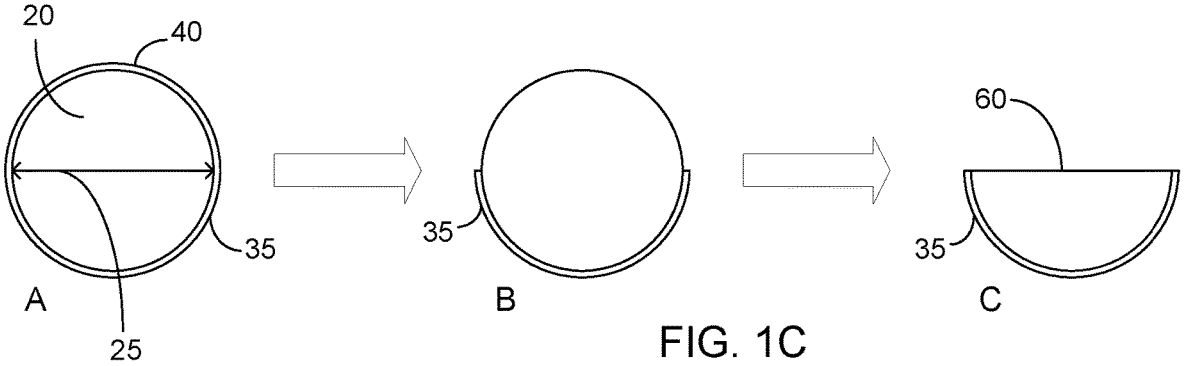

FIG. 1A illustrates a high level cut away view of an ultrafine wire 10 and a fine wire 20 with a conductive material 30 disposed thereon, FIG. 1B illustrates a high level side view of ultrafine wire 10, fine wire 20 and conductive material 30, and FIG. 1C illustrates cut away views of stages of creating a flat surface on fine wire 20, FIGS. 1A-1C being described together. Ultrafine wire 10 exhibits a maximal cross-section 15 which is smaller than a maximal cross-section 25 of fine wire 20. Specifically, the maximal cross-section 15 of ultrafine wire 10 is less than 25 microns and the maximal cross-section 25 of fine wire 20 is 25-100 microns. Preferably both fine wire 20 and the ultra-fine wire 10 are copper wires covered with a coating of insulation, such as a lacquer.

Fine wire 20 and ultra-fine wire 10 are particularly difficult to work with, as they are not clearly visible to the naked eye, and easily shift position, for example responsive to air currents. In typical embodiments there is a lack of space for the use of terminals or other contacts, and thus the embodiments herein are advantageous for use with wire to wire contacts where no extraneous space for support structures are provided.

As illustrated in stage A of FIG. 1C, in one non-limiting embodiment fine wire 20 is provided with insulation 35 extending all the way to an edge 22 of fine wire 20. In another embodiment (not shown), fine wire 20 is provided with a portion of insulation 35 already removed.

As illustrated in stage B of FIG. 1C, insulation 35 around a predetermined section 40 of a predetermined portion 50 of fine wire 20 is removed. Particularly, predetermined portion 50 is the portion of fine wire 20 beginning from an edge 22 thereof for a predetermined length, optionally between 0.1-1 millimeter. Predetermined section 40 is a section of predetermined portion 50 of fine wire 20 exhibiting a flat surface 60. In one embodiment, fine wire 20 is a flat wire and insulation 35 is removed to expose flat surface 60 of the flat fine wire 20. In another embodiment, as illustrated, fine wire 20 is a round wire, and in stage C predetermined section 40 is removed to form flat surface 60.

As illustrated in FIGS. 1A-1B, conductive material 30 is deposited on flat surface 60. In one embodiment, conductive material 30 is gold. In one embodiment the conductive material 30 is formed by a process of gold plating. Advantageously the gold plating occurs only on the exposed flat surface 60, since the balance of the wire remains coated by insulation 35. At least a predetermined portion 80 of the ultrafine wire 10 is uninsulated. As opposed to fine wire 20 where only a section 40 of insulation 35 of predetermined portion 50 is removed, the insulation of ultrafine wire 10 is preferably removed around the entire circumference of predetermined portion 80, as illustrated in FIG. 1A.

Figure 1D:
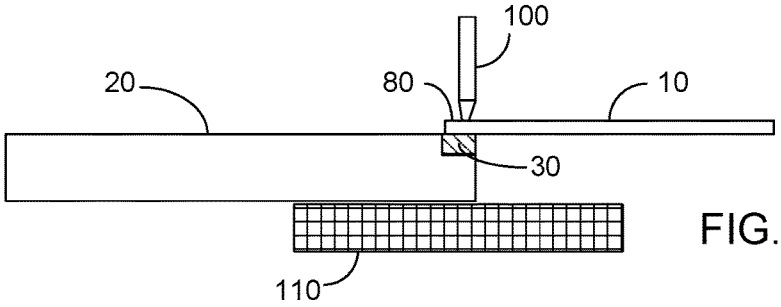

As illustrated in FIG. 1D, a thermocompression bonder 100 is applied to bond predetermined portion 80 of ultrafine wire 10 to conductive material 30, and to further bond conductive material 30 to flat surface 60, by thermocompression, providing both heat and pressure. Thermocopression bonding is bonding performed at a predetermine pressure and temperature, and is preferably performed over a predetermined time period. Thermocompression bonding thus does not use ultrasonic energy, or a flow of electricity through the bond, as the source of bonding energy. Thermocompression bonding forms a durable electrical connection between ultrafine wire 10 and fine wire 20. Advantageously, flat surface 60 allows for improved thermocompression bonding. In one embodiment, the thermocompression is performed at the minimal temperature necessary to prevent burning/erosion of the ultrafine wire 10. In an embodiment where conductive material 30 is gold and ultrafine wire 10 and fine wire 20 are composed of copper, the temperature of thermocompresson bonding is performed at between 450 and 600 degrees C., preferably between 500 and 600 degrees C., with a pressure of between 0.3-15 grams, the temperature and pressure applied for time period of 2-30 milliseconds. The precise temperature, pressure and time utilized are a function of the actual ultrafine wire 10 and fine wire 20 utilized, particularly the diameters of ultrafine wire 10 and fine wire 20. Typically, the thinner the wire the shorter the time. In certain embodiments, the precise pressure is a function of the diameter of ultrafine wire 10. In one embodiment, the thermocompression bonding is performed on a table 110 to improve the thermocompression bonding results. Preferably table 110 is a stable surface appropriate for use with the high temperatures and pressures associated with thermocompression bonding. The process thus provides proper diffusion and molecular adhesion between ultrafine wire 10 and fine wire 20.

Figure 1E:
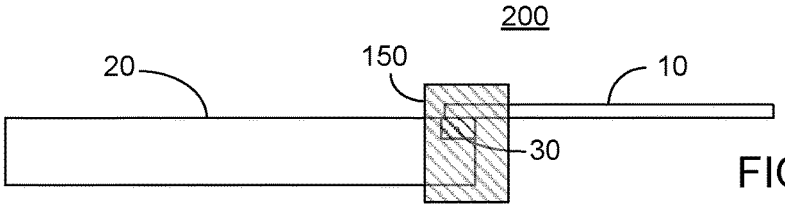

As illustrated in FIG. 1E, after the bonding process of FIG. 1D, insulation 150 is applied to the bond structure such that the connection of ultrafine wire 10 and fine wire 20 is insulated to form a stable structure 200. In one embodiment, the insulation exhibits adhesive properties. Optionally, the insulation is composed of a cyanoacrylate adhesive. The adhesive properties allow a plurality of ultrafine wires 10, connected to fine wires 20, to be connected to each other to thereby form stable structure 200, optionally covered by a casing. In one embodiment, each ultrafine wire 10 is wound as a coil, thereby forming an assembly whose ultrafine wires 10 are each connected to a respective fine wire 20, as described above. Thus, stable structure 200 may act as an anchor for a run of fine wire 20 for connection to a remote device or connection point. In one non-limiting embodiment, insulation 150 formed of an adhesive, is attached to a wall of the device comprising the ultrafine wire, thus forming stable structure 200. Stable structure 200 thus acts an anchor for a run of fine wire 20 to a remote device or connection point without placing mechanical stress on ultrafine wire 10.

Figure 2:
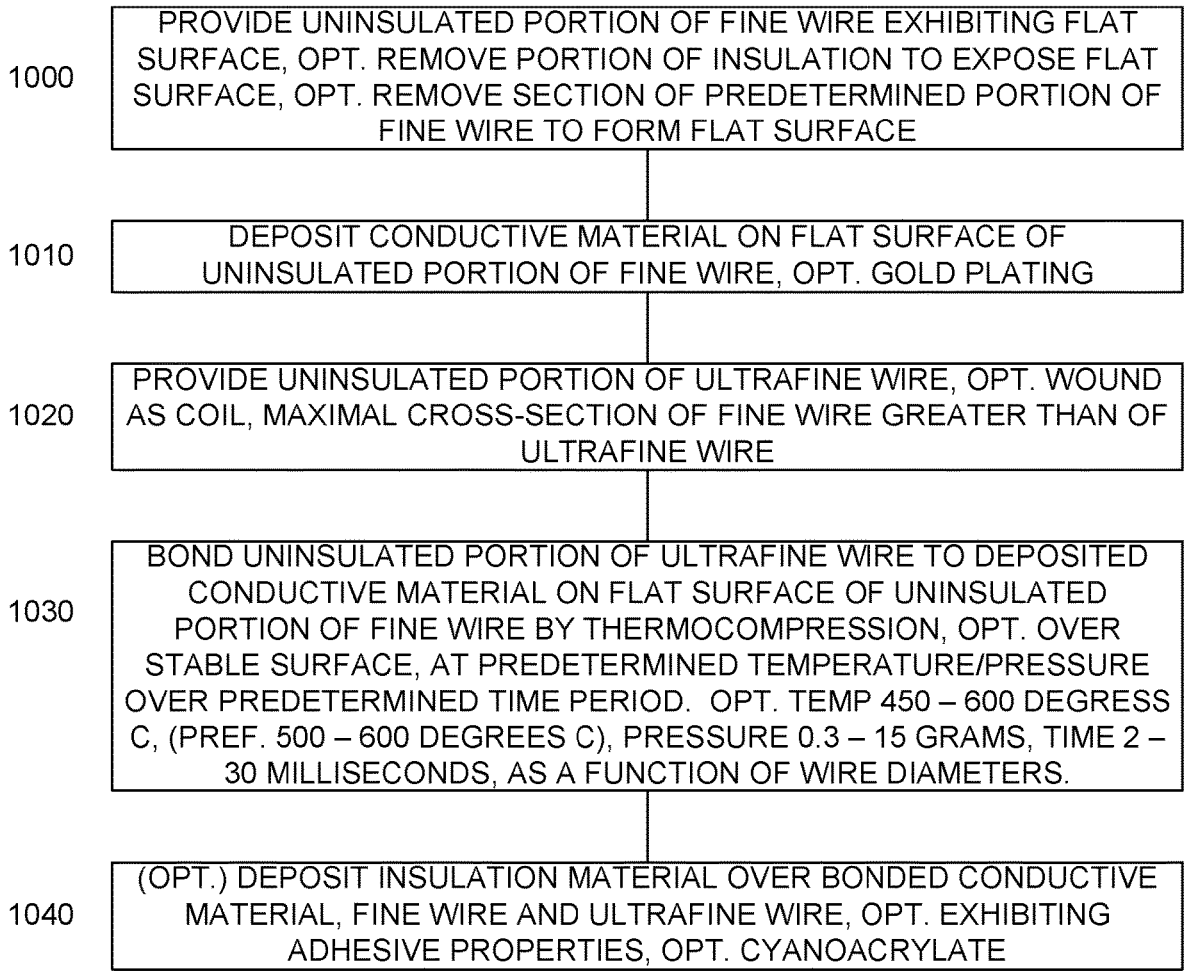

FIG. 2 illustrates a high level flow chart of a method of connecting an ultrafine wire to a fine wire, according to certain embodiments. In stage 1000, an uninsulated portion of a fine wire is provided, the uninsulated portion exhibiting a flat surface. In one embodiment, a portion of the insulation is removed to expose the flat surface. In another embodiment, a section of the predetermined portion of the fine wire is removed to form the flat surface.

In stage 1010, a conductive material is deposited on the flat surface of the uninsulated portion of the fine wire of stage 1000. Optionally, the conductive material comprises gold. In stage 1020, an uninsulated portion of an ultrafine wire is provided, the maximal cross-section of the fine wire of stage 1000 greater than the maximal cross-section of the ultrafine wire. Optionally, the maximal cross-section of the ultrafine wire is less than 25 microns and the maximal cross-section of the fine wire is 25-100 microns.

In stage 1030, the uninsulated portion of the ultrafine wire of stage 1020 is bonded to the conductive material of stage 1010 deposited of the flat surface of the uninsulated portion of the fine wire by thermocompression, with a predetermined pressure and temperature profile. Optionally, the thermocompression is performed over a stable surface. Optionally, thermocompression is performed at a temperature of between 450 and 600 degrees C., preferably between 500 and 600 degrees C., with a pressure of between 0.3-15 grams. The heat and pressure are applied for a time period of 2-30 milliseconds. The precise temperature, pressure and time utilized are a function of the actual ultrafine wire and fine wire utilized, particularly the diameters of ultrafine wire of stage 1020 and fine wire of stage 1000. Typically, the thinner the wire the shorter the time. The precise pressure is a function of the diameter of the ultrafine wire of stage 1020.

In optional stage 1040, insulation material is deposited over the bonded conductive material, ultrafine wire and fine wire of stage 1030. Optionally, the insulation material exhibits adhesive properties. Further optionally, the insulation material comprises cyanoacrylate. In one non-limiting embodiment, adhesive insulation material is further attached to a wall of the device comprising the ultrafine wire, thus forming a stable structure. Such a stable structure acts an anchor for a run of fine wire to a remote device or connection point without placing mechanical stress on the ultrafine wire.

Figure 3:
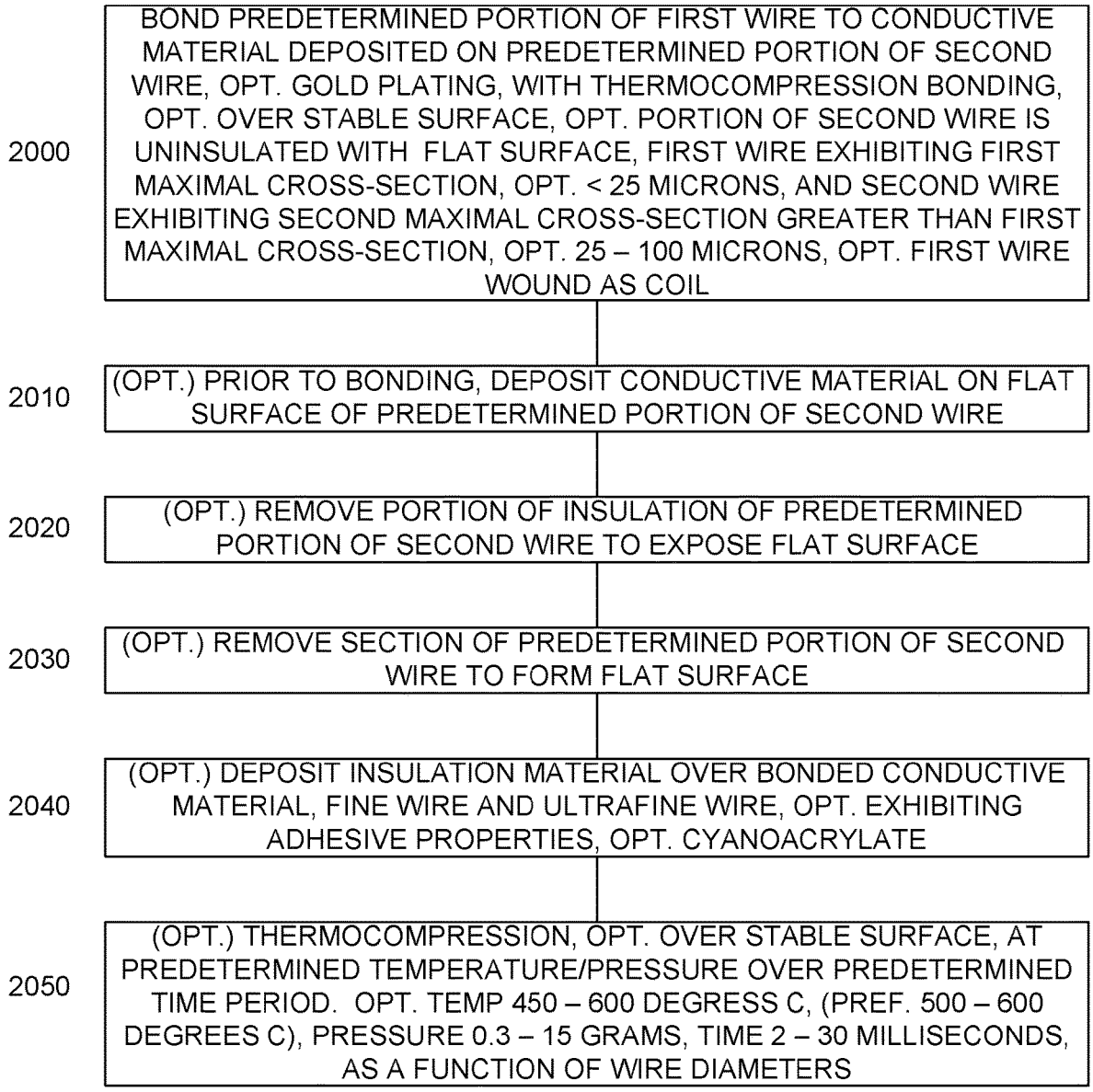

FIG. 3 illustrates a high level flow chart of a method of connecting a first wire to a second wire, according to certain embodiments. In stage 2000, a predetermined portion of a first wire is bonded to a conductive material on a predetermined portion of a second wire by thermocompression, with a predetermined temperature/pressure profile for a predetermined time period. The first wire exhibits a first maximal cross-section and the second wire exhibits a second maximal cross-section, greater than the first maximal cross-section. In one embodiment, the first maximal cross-section is less than 25 microns and the second maximal cross-section is 25-100 microns. In another embodiment, the conductive material comprises gold. In one embodiment, the thermocompression bonding is performed over a stable surface. In another embodiment, the predetermined portion of the second wire is uninsulated with a flat surface. In one embodiment, the first wire is wound as a coil.

In optional stage 2010, prior to the bonding of stage 2000, the conductive material is deposited on a flat surface of the predetermined portion of the second wire. In optional stage 2020, a portion of insulation is removed from the predetermined portion of the second wire of stage 2000 to expose the flat surface of optional stage 2010. In optional stage 2030, a section of the predetermined portion of the second wire of stage 2000 is removed to form the flat surface of optional stage 2010. In optional stage 2040, insulation material is deposited over the bonded conductive material, first wire and second wire of stage 2000. Optionally, the insulation material exhibits adhesive properties. Further optionally, the insulation material comprises cyanoacrylate.

In optional stage 2050, the thermocompression bonding of stage 2000 is performed at a temperature of between 450 and 600 degrees C., preferably between 500 and 600 degrees C., with a pressure of between 0.3-15 grams. The heat and pressure are applied for a time period of 2-30 milliseconds. The precise temperature, pressure and time utilized are a function of the actual ultrafine wire and fine wire utilized, particularly the diameters of ultrafine wire and fine wire of stage 2000. Typically, the thinner the wire the shorter the time. The precise pressure is a function of the diameter of the ultrafine wire utilized.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof, which would occur to persons skilled in the art upon reading the foregoing description.

The invention claimed is:

1. A method of connecting an ultrafine wire to a fine wire, the fine wire exhibiting a maximal cross-section of 25-100 microns and the ultrafine wire exhibiting a maximal cross-section of less than 25 microns, the method comprising:

providing an uninsulated portion of the fine wire exhibiting a flat surface;

depositing gold on the flat surface of said provided uninsulated portion of the fine wire;

providing an uninsulated portion of the ultrafine wire; and bonding said provided uninsulated portion of the ultrafine wire to said deposited gold on the flat surface of said provided uninsulated portion of the fine wire, said bonding accomplished by thermocompression utilizing a predetermined temperature and pressure profile over a predetermined time.

2. The method of claim 1, wherein said providing the uninsulated portion of the fine wire comprises removing a portion of insulation from the fine wire to expose the flat surface.

3. The method of claim 1, wherein said providing the uninsulated portion of the fine wire comprises removing a section of the uninsulated portion of the fine wire to form the flat surface.

4. The method of claim 1, wherein the depositing of said gold comprises plating the flat surface with said gold.

5. The method of claim 1, wherein said thermocompression bonding is performed over a stable surface.

6. The method of claim 1, further comprising depositing insulation material over said bonded gold and ultrafine wire.

7. The method of claim 6, wherein the insulation material exhibits adhesive properties.

8. The method of claim 1, wherein each of the fine wire and the ultrafine wire is copper.

9. A method of connecting a first wire to a second wire, the first wire exhibiting a maximal cross-section of less than 25 microns and the second wire exhibiting a maximal cross-section of 25-100 microns, the method comprising bonding a predetermined portion of the first wire to gold deposited on a predetermined portion of the second wire, wherein said bonding is accomplished by thermocompression utilizing a predetermined temperature and pressure profile over a predetermined time.

10. The method of claim 9, wherein the predetermined portion of the second wire is uninsulated and exhibits a flat surface, and wherein, prior to said bonding, the method further comprises depositing the gold on the flat surface of the predetermined portion of the second wire by plating the flat surface with said gold.

11. The method of claim 10, further comprising removing a portion of insulation from the predetermined portion of the second wire to expose the flat surface.

12. The method of claim 10, further comprising removing a section of the predetermined portion of the second wire to form the flat surface.

13. The method of claim 9, further comprising depositing insulation material over said bonded gold and first wire.

14. The method of claim 13, wherein the insulation material exhibits adhesive properties.

15. The method of claim 9, wherein each of the first wire and the second wire is copper.

* * * * *